US009885496B2

(12) United States Patent
Karkow et al.

(10) Patent No.: US 9,885,496 B2
(45) Date of Patent: Feb. 6, 2018

(54) FLUID HEATER WITH PERFORATED FLAME HOLDER

(71) Applicant: ClearSign Combustion Corporation, Seattle, WA (US)

(72) Inventors: Douglas W. Karkow, Des Moines, WA (US); Joseph Colannino, Bellevue, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 99 days.

(21) Appl. No.: 14/811,758

(22) Filed: Jul. 28, 2015

(65) Prior Publication Data

US 2016/0025374 A1 Jan. 28, 2016

Related U.S. Application Data

(60) Provisional application No. 62/029,792, filed on Jul. 28, 2014.

(51) Int. Cl.

| | |
|---|---|
| ***F22B 37/06*** | (2006.01) |
| ***F24H 9/20*** | (2006.01) |
| ***F24H 1/20*** | (2006.01) |
| ***F24H 1/00*** | (2006.01) |
| ***F24H 1/18*** | (2006.01) |
| ***F24H 9/18*** | (2006.01) |

(Continued)

(52) U.S. Cl.

CPC ..... *F24H 1/205* (2013.01); *F23D 14/02* (2013.01); *F23D 14/583* (2013.01); *F23D 14/64* (2013.01); *F24H 1/0036* (2013.01); *F24H 1/18* (2013.01); *F24H 9/1836* (2013.01)

(58) Field of Classification Search

USPC ..... 122/14.1, 155.1, 155.2, 156, 157, 167, 122/135.1

See application file for complete search history.

(56) References Cited

U.S. PATENT DOCUMENTS 15,424 A * 7/1856 Ingalls ..... F24H 1/26 122/124

2,095,065 A 10/1937 Hays (Continued)

FOREIGN PATENT DOCUMENTS

| | | |
|---|---|---|
| JP | 60-073242 | 4/1985 |
| WO | WO 1995/000803 | 1/1995 |

(Continued)

OTHER PUBLICATIONS

Arnold Schwarzenegger, A Low NOx Porous Ceramics Burner Performance Study, California Energy Commission Public Interest Energy Research Program, Dec. 2007, 5, San Diego State University Foundation.

(Continued)

*Primary Examiner* — Gregory A Wilson

(74) *Attorney, Agent, or Firm* — Christopher A. Wiklof; Nicholas A. Bromer; Launchpad IP, Inc.

(57) ABSTRACT

A water heater includes a water tank having an inlet and an outlet, and a flue extending through the tank. A nozzle is positioned near a first end of the flue, arranged so as to emit a fuel stream into the flue, and a flame holder is located within the flue in a position to receive the fuel stream and to hold a flame entirely within the flue.

16 Claims, 8 Drawing Sheets

(51) Int. Cl.

| | |
|---|---|
| ***F23D 14/02*** | (2006.01) |
| ***F23D 14/58*** | (2006.01) |
| ***F23D 14/64*** | (2006.01) |

(56) References Cited

U.S. PATENT DOCUMENTS

| | | | | |
|---|---|---|---|---|
| 3,008,513 | A | 11/1961 | Holden | |
| 3,809,061 | A * | 5/1974 | Gerstmann | F22B 27/08 122/18.4 |
| 3,890,935 | A * | 6/1975 | Moss | F28C 3/16 110/264 |
| 4,021,188 | A | 5/1977 | Yamagishi et al. | |
| 4,023,558 | A * | 5/1977 | Lazaridis | F24H 1/12 122/156 |
| 4,081,958 | A * | 4/1978 | Schelp | F23R 3/40 431/170 |
| 4,220,846 | A * | 9/1980 | Rice | F24H 3/0405 252/502 |
| 4,266,513 | A * | 5/1981 | Schaus | F24H 1/205 110/323 |
| 4,397,356 | A * | 8/1983 | Retallick | E21B 36/02 122/31.1 |
| 4,408,461 | A | 10/1983 | Bruhwiler et al. | |
| 4,588,373 | A | 5/1986 | Tonon et al. | |
| 4,643,667 | A | 2/1987 | Fleming | |
| 4,651,712 | A * | 3/1987 | Davis | B08B 3/02 126/110 R |
| 4,673,349 | A | 6/1987 | Abe et al. | |
| 4,752,213 | A | 6/1988 | Grochowski et al. | |
| 4,780,076 | A * | 10/1988 | Davis | B08B 3/026 122/24 |
| 4,899,696 | A * | 2/1990 | Kennedy | F24H 1/206 122/135.1 |
| 5,235,667 | A | 8/1993 | Canfield et al. | |
| 5,326,257 | A | 7/1994 | Taylor et al. | |
| 5,365,887 | A * | 11/1994 | Fenn | F24H 1/145 122/155.2 |
| 5,441,402 | A | 8/1995 | Reuther et al. | |
| 5,511,516 | A | 4/1996 | Moore, Jr. et al. | |
| 5,797,356 | A * | 8/1998 | Khizh | F24H 1/205 122/135.3 |
| 5,899,686 | A * | 5/1999 | Carbone | F23D 14/04 126/91 A |
| 6,338,319 | B1 * | 1/2002 | Vago | F24H 9/1836 122/13.01 |
| 6,997,701 | B2 | 2/2006 | Volkert et al. | |
| 7,360,506 | B2 * | 4/2008 | Shellenberger | F23G 7/07 122/13.01 |
| 8,375,897 | B2 * | 2/2013 | Smith | F24H 1/206 122/13.3 |
| 9,377,190 | B2 | 6/2016 | Karkow et al. | |
| 9,388,981 | B2 | 7/2016 | Karkow et al. | |
| 9,447,965 | B2 | 9/2016 | Karkow et al. | |
| 2007/0186872 | A1 * | 8/2007 | Shellenberger | F23G 7/07 122/4 D |
| 2009/0111063 | A1 | 4/2009 | Boardman et al. | |
| 2010/0178219 | A1 | 7/2010 | Verykios et al. | |
| 2011/0076628 | A1 | 3/2011 | Miura et al. | |
| 2015/0118629 | A1 | 4/2015 | Colannino et al. | |
| 2015/0276212 | A1 * | 10/2015 | Karkow | F23D 14/74 431/253 |
| 2015/0276217 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0362177 | A1 | 12/2015 | Krichtafovitch et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0091200 | A1 | 3/2016 | Colannino et al. | |
| 2016/0230984 | A1 | 8/2016 | Colannino et al. | |
| 2017/0010019 | A1 * | 1/2017 | Karkow | F23M 9/06 |

FOREIGN PATENT DOCUMENTS

| | | |
|---|---|---|
| WO | 2015/042615 | 3/2015 |
| WO | 2015/054323 | 4/2015 |
| WO | 2015/061760 | 4/2015 |
| WO | 2015/070188 | 5/2015 |
| WO | 2015/112950 | 7/2015 |
| WO | 2015/123149 | 8/2015 |
| WO | 2015/123381 | 8/2015 |
| WO | 2015/123670 | 8/2015 |
| WO | 2015/123683 | 8/2015 |
| WO | 2015/123694 | 8/2015 |
| WO | 2015/123696 | 8/2015 |
| WO | 2015/123701 | 8/2015 |
| WO | 2016/007564 | 1/2016 |

OTHER PUBLICATIONS

Fric , Thomas F., "Effects of Fuel-Air Unmixedness on NOx Emissions," Sep.-Oct. 1991 Journal of Propulsion and Power, vol. 9, No. 5, pp. 708-713.

* cited by examiner

FLUID HEATER WITH PERFORATED FLAME HOLDER

CROSS REFERENCE TO RELATED APPLICATIONS

The present application claims priority benefit from U.S. Provisional Patent Application No. 62/029,792; entitled "WATER HEATER WITH PERFORATED FLAME HOLDER, AND METHOD OF OPERATION"; filed Jul. 28, 2014, co-pending at time of filing, which, to the extent not inconsistent with the disclosure herein, is incorporated by reference.

The present application is related to U.S. Non-Provisional patent application No. TBD, entitled "WATER HEATER WITH A VARIABLE-OUTPUT BURNER INCLUDING A PERFORATED FLAME HOLDER AND METHOD OF OPERATION", filed Jul. 28, 2015; which, to the extent not inconsistent with the disclosure herein, is incorporated by reference.

SUMMARY

According to an embodiment, a fluid heater includes a tank having an inlet and an outlet, a flue extending through the tank, a fuel nozzle positioned near a first end of the flue and configured to emit a fuel stream into the flue, and a flame holder located within the flue in a position to receive the fuel stream and to hold a flame entirely within the flue. According to an embodiment, the flame holder includes a perforated flame holder having a plurality of apertures extending through the flame holder parallel to a longitudinal axis of the flue. Combustion of the fuel can occur in the plurality of apertures. Heat liberated from the combustion raises the temperature of the flame holder, which can glow incandescently when in operation. Infrared radiation from the flame holder and convective heat transfer from heated combustion products heats the wall of the flue and the flue convectively heats the fluid. At least a portion of the wall of the flue can be nominally maintained near the temperature of the fluid by convection within the fluid. Thus, a portion of the system can nominally be classified as a cool wall burner.

According to an embodiment, a water heater is provided, including a tank having an inlet and an outlet, a flue extending through the tank, a flame holder, and a nozzle positioned and configured to emit a fuel stream toward the flame holder. The flame holder includes a plurality of apertures extending therethrough, and is configured to hold a flame substantially within the plurality of apertures, the flame holder being positioned to transfer heat to water inside the tank.

According to an embodiment, the flame holder is located inside the flue in a position that is no higher than a midpoint of the flue. According to another embodiment, the flame holder is positioned within the flue between the midpoint and a point that is about one-third of the total length of the flue down from the top of the flue.

According to an embodiment, the water heater includes a temperature sensor configured to detect a temperature of fluid within the tank at a position near a bottom portion of the tank, and a controller configured to receive a signal from the sensor and to control a flow of fuel to the nozzle according to the temperature of the fluid.

According to an embodiment, a water heater includes a combustion tube having a length L, the combustion tube defining an air column on an inside of the tube and a water volume outside of the tube. The combustion tube has an inlet end configured to receive combustion air and an outlet end configured to output combustion products. A hydrocarbon gas nozzle is configured to output a hydrocarbon gas stream into the air column inside of the tube. A perforated flame holder is disposed in the air column, the perforated flame holder having a body with a thickness t. The body defines an input side aligned to receive the hydrocarbon gas stream and the combustion air, an output side opposite the input side disposed to output the combustion products, and a plurality of perforations extending through the thickness t from the input side to the output side. The perforated flame holder is configured to hold a combustion reaction supported by the hydrocarbon gas and the combustion air within the plurality of perforations. A support structure is configured to support the perforated flame holder between the inlet end and the outlet end of the combustion tube at a distance not equal to L/4 from the inlet end of the combustion tube.

DETAILED DESCRIPTION

Figure 1:
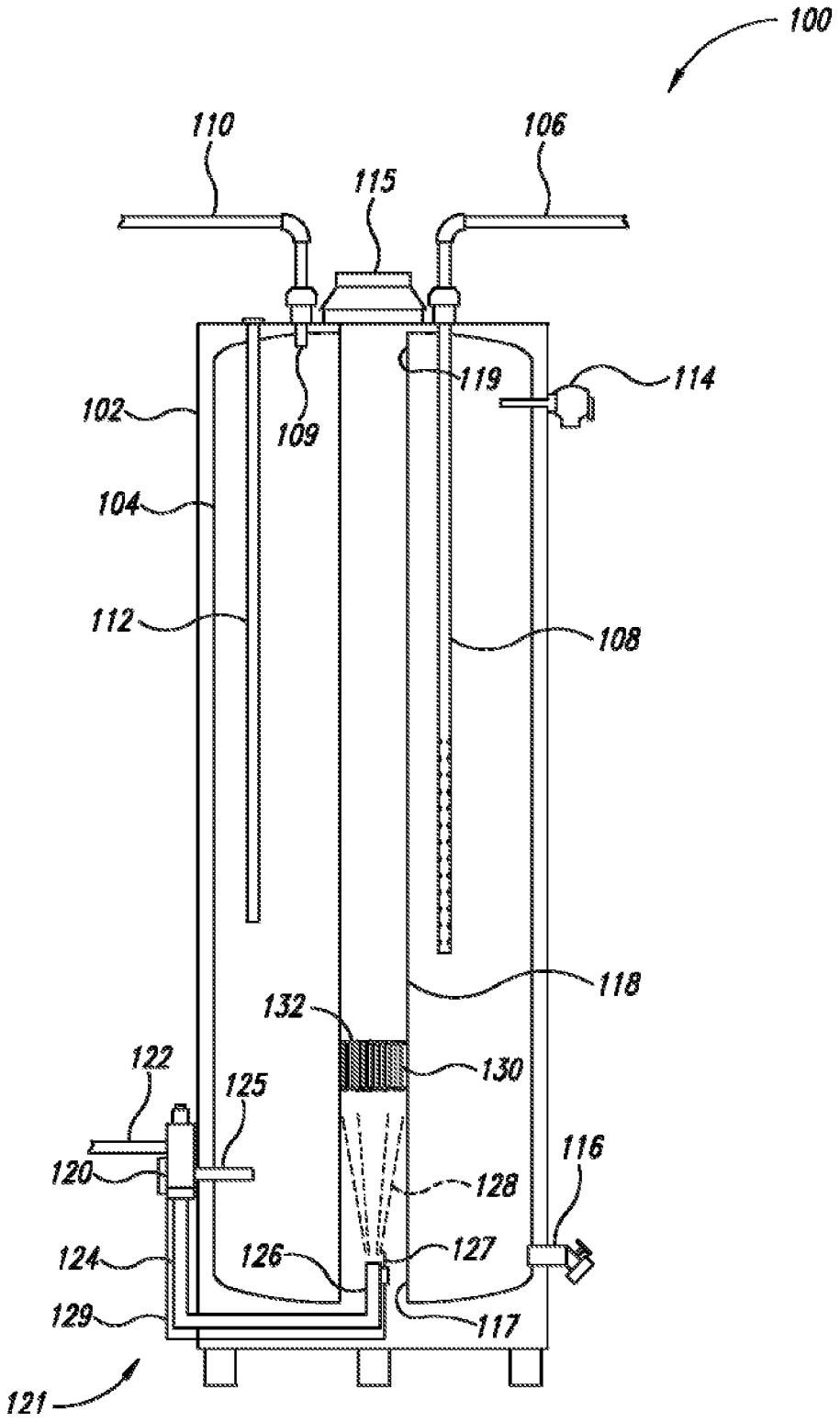
FIG. 1 is a cross-sectional diagram of a water heater system, according to an embodiment.

In the following detailed description, reference is made to the accompanying drawings, which form a part hereof. In the drawings, similar symbols typically identify similar components, unless context dictates otherwise. The illustrative embodiments described in the detailed description and drawings do not limit the scope of the claims. Other embodiments may be utilized, and other changes may be made, without departing from the spirit or scope of the subject matter presented here.

As used in the specification and claims, the term flame is to be construed as reading on a combustion reaction between a fuel and an oxidizer. The terms perforations and apertures are used interchangeably herein.

FIG. 1 is a diagram of a water heater system 100, according to an embodiment. The water heater system 100 includes an outer casing 102 and a water tank 104. A cold-water line 106 is coupled to an inlet 108, while hot water exits the tank 104 via an outlet 109 to a hot-water line 110. A sacrificial anode rod 112 is typically used to control corrosion within the tank 104 in a per se known manner. A pressure relief valve 114 is configured to open at a selected relatively high pressure value, in order to prevent overpressurization of the tank 104, while a drain outlet 116 is provided to enable draining of the tank 104. A flue 118, including a first end 117 and a second end 119, extends through the tank 104, preferably along a longitudinal axis of the tank 104. A vent hood 115 is positioned over the flue 118, and is configured to be coupled to a gas vent, chimney, etc., in order to convey flue gases to the exterior of a building in which the water heater system 100 is positioned.

A burner mechanism 121 is provided, configured to heat water in the tank 104 by supporting and controlling a combustion reaction fed by a combustible fuel. The burner mechanism 121 includes a controller 120, with a fuel inlet 122 and a burner supply line 124. A temperature sensor 125 is positioned and configured to monitor the temperature of water in a lower portion of the tank 104. A fuel nozzle 126 is positioned near or inside the first end 117 of the flue 118. The nozzle 126 is coupled to receive fuel from the burner supply line 124, and is configured to emit a fuel stream 128 into the flue 118. A flame holder 130 is positioned inside the flue 118, and is configured to hold a flame 132 that is fed by the fuel stream 128. The controller 120 includes a fuel valve by which it is configured to regulate the flow of fuel from the inlet line 122 to the burner supply line 124, according to the water temperature, as detected by the temperature sensor 125. According to an embodiment, an igniter 127 is coupled to the controller 120 via a connector 129, and is positioned to ignite the fuel stream 128 when activated.

Figure 2:
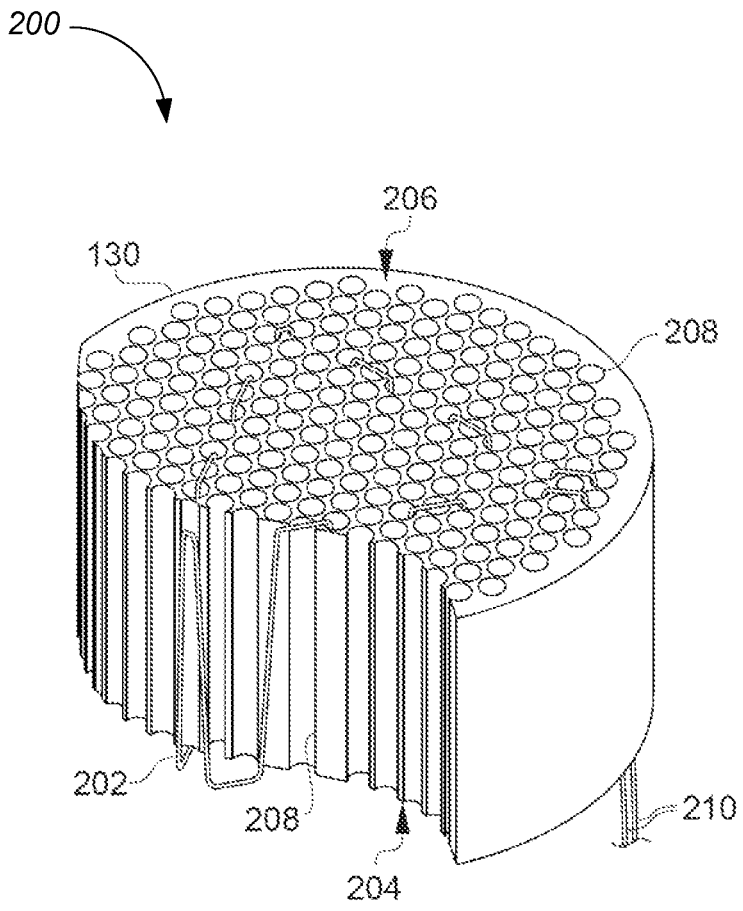
FIG. 2 is an enlarged perspective view of the perforated flame holder of FIG. 1, partially cut away to show additional details, according to an embodiment.

The flame holder 130 includes a plurality of apertures extending through the flame holder 130 substantially parallel to a longitudinal axis of the flue 118 (the flame holder 130 is shown in more detail in FIG. 2). Detailed descriptions of the operation of a perforated flame holder of the type shown in the embodiment of FIG. 1 can be found in PCT application No. PCT/US2014/062291, entitled "SYSTEM AND COMBUSTION REACTION HOLDER CONFIGURED TO TRANSFER HEAT FROM A COMBUSTION REACTION TO A FLUID", filed Oct. 24, 2014; PCT application No. PCT/US2014/016632, entitled "FUEL COMBUSTION SYSTEM WITH A PERFORATED REACTION HOLDER, filed Feb. 14, 2014; PCT application No. PCT/US2014/016628, entitled "PERFORATED FLAME HOLDER AND BURNER INCLUDING A PERFORATED FLAME HOLDER", filed Feb. 14, 2014; and PCT patent application No. PCT/US2014/016622, entitled "STARTUP METHOD AND MECHANISM FOR A BURNER HAVING A PERFORATED FLAME HOLDER", filed Feb. 14, 2014; each of which is incorporated herein by reference in its entirety.

The flame holder 130 is configured to hold the flame 132 substantially within the apertures extending therethrough, although in many cases, the flame 132 may extend a small distance above and/or below the flame holder 130. During operation of the system 100 in a heating mode, the controller 120 supplies fuel to the nozzle 126, which emits the fuel in the fuel stream 128 toward the flame holder 130. Air drawn into the flue 118 via the first end 117 is entrained by the fuel stream 128, and the air/fuel mixture is combusted by the flame 132, primarily within the apertures of the flame holder 130. Heat from the flame 132 is transmitted to the water in the tank 104 via conduction, at the locations where either the flame 132 or the flame holder 130 are in direct contact with the inner surface of the flue 118, by radiation, primarily from the first and second faces of the flame holder 130 to more distant portions of the flue 118, and by convection, as hot flue gases—i.e., gases containing combustion products from the flame 132—rise through the flue 118 and eventually pass through the vent hood 115 to an appropriate vent system. The gases transfer heat along the length of the flue 118 to the water in the tank 104 as they rise toward the second end 119.

As explained in detail in the above-referenced patent applications, a perforated flame holder of the type described with reference to the embodiments disclosed herein should typically be preheated to a minimum operating temperature prior to operating to heat water in the tank 104. Thus, normal operation of the water heater system 100 preferably includes at least three modes of operation: (1) a standby mode, in which no fuel is supplied to the nozzle 126 and no heat is generated by the burner mechanism 121; (2) a start-up mode, during which the flame holder 130 is heated to a minimum operating temperature; and (3) a heating mode, in which heat is produced by the flame 132 held by the flame holder 130, and some portion of that heat is conveyed to water inside the tank 104. Other embodiments can include additional modes of operation, some of which will be described later.

During normal operation of the water heater system 100, the controller 120 monitors the water temperature via the temperature sensor 125. While the water temperature is above a first temperature threshold, no fuel is supplied to the nozzle 126, and the system 100 operates in the standby mode. As hot water is drawn from the tank 104 via the outlet 109, cold water enters the tank 104 via the inlet 108. Being denser than the hot water in the tank 104, the cold water sinks to the bottom of the tank so that the temperature of the water in the lower portion of the tank begins to drop. When the temperature drops below the first temperature threshold, the controller 120 changes the operating mode to the start-up mode to preheat the flame holder 130. When the flame holder 130 has reached at least its minimum operating temperature, the controller 120 shifts to the heating mode and the burner mechanism 121 generates heat that is transferred to the water in the tank 104, heating the water. When the water temperature rises above a second temperature threshold, greater than the first temperature threshold, the controller 120 closes the valve between the fuel inlet 122 and the burner supply line 124. With the fuel supply cut off, the flame 132 consumes any remaining fuel, then goes out, and the system 100 returns to the standby mode.

The controller 120 can be configured to control operation of the burner mechanism 121 in response to a fluid temperature value obtained on the basis of the signal from a single temperature sensor 125, as described above, or from signals from multiple sensor, and employing any of a number of weighting schemes to achieve a desired degree of accuracy and/or responsiveness.

According to an embodiment, parameters such as the volume and velocity of the fuel stream 128—as determined by the pressure of the fuel supplied by the controller 120 and the configuration of the nozzle 126—and the distance between the nozzle 126 and the flame holder 130 are selected such that during operation of the water heater system 100 in the heating mode, velocity of the fuel stream 128 as it exits the nozzle 126 is much greater than a flame propagation speed for the particular fuel, so that, by the time the fuel stream velocity slows to the flame propagation speed, air entrained by the fuel stream 128 has rendered the fuel stream 128 too lean to support combustion. However, the elevated temperate of the flame holder 130 is sufficient to support combustion within the apertures of the flame holder 130, even given the very lean fuel mixture at that distance from the nozzle 126. Thus, the flame 132 is held substantially within the apertures of the flame holder 130 without propagating toward the nozzle 126. A small portion of the heat produced by the flame 132 is expended in maintaining the operating temperature of the flame holder 130, while most of the heat is transmitted to the water in the tank 104 surrounding the flame holder 130.

In order for the flame holder 130 to begin operation, it is preheated so that it can support combustion within its apertures. Any of a number of different start-up procedures can be employed to preheat the flame holder 130, many of which are disclosed in the above-referenced patent applications. A few of the various procedures are described below.

According to an embodiment, during start-up mode operation of the water heater 100, the controller 120 is configured to admit fuel to the burner supply line 124 at a reduced pressure, relative to the fuel pressure during heating mode operation, resulting in a lower velocity fuel stream 128 exiting from the nozzle 126. The igniter 127 is energized to ignite a preheat flame that is supported within the lower-velocity fuel stream 128 between the nozzle and the flame holder 130. In this position, the preheat flame quickly heats the flame holder 130, or at least a portion thereof, to its minimum operating temperature, after which the controller 120 is configured to increase the fuel pressure to a selected operating pressure. With increased fuel pressure, there is a corresponding increase in velocity of the fuel stream 128, and the preheat flame is no longer supportable between the nozzle 126 and the flame holder 130. The preheat flame is either extinguished or carried downstream by the high-velocity fuel stream 128. Having been preheated, the flame holder 130 captures or reignites the flame 132 in the position shown in FIG. 1, and operation of the system 100 in the heating mode proceeds.

According to another embodiment, the controller 120 supplies fuel at the selected operating pressure, but is configured to energize the igniter 127 during the entire start-up period, so that the igniter 127 acts temporarily to hold the preheat flame within the fuel stream 128 for a time sufficient to preheat the flame holder 130, after which the igniter 127 is de-energized and operation in the heating mode proceeds substantially as described above.

According to another embodiment, an electric heating element is employed to preheat the flame holder 130, as will be described in more detail below, with reference to FIG. 2.

According to an embodiment, a sensor is positioned and configured to detect a temperature of the flame holder 130, and the controller 120 is configured to transition from the start-up mode to the heating mode on the basis of the detected temperature. According to another embodiment, the controller 120 includes a timer, and is configured to operate in the start-up mode for a preselected time period that is known to be sufficient to adequately preheat the flame holder 130, and at the end of which is configured to transition to operation in the heating mode.

The position of the flame holder 130 within the flue 118 can affect the efficiency of operation of the system 100, the rate at which heat can be conveyed to water in the tank 104, and how much of the water can be effectively heated. For example, if the flame holder 130 is positioned very close to the first end 117 of the flue 118, a distance between the flame holder 130 and the second end 119 of the flue 118 is increased, meaning that a larger percentage of the heat carried by the flue gases will be transferred to the water via the walls of the flue 118 before the gases exit the flue 118. However, if the flame holder 130 is positioned near the first end 117, a greater portion of heat radiated downward from the flame holder 130 may escape the flue 118 via the opening of the first end 117, offsetting to some degree the increased heat capture from the flue gases.

If the flame holder 130 is positioned higher in the flue 118, i.e., within the top one-third of the flue 118, the recovery time of the water heater system 100 may be reduced, inasmuch as water closer to the outlet 109 will be exposed to the high temperature of the flame holder 130 transmitted via conduction, and the heated water will lose less heat to water above it as it rises toward the top. Additionally, with the flame holder 130 positioned higher in the flue 118, the flue gases will not have lost as much heat before they reach the uppermost portion of the flue 118. As is well understood, hot water within a water tank rises toward the top, so the hottest water is at the top of the tank 104, while flue gases are coolest at the top end of the flue 118, having transferred heat to the flue 118 as they rise from the flame holder 130. Thus, heat transfer efficiency is lowest near the second end 119 of the flue 118. With the flame holder 130 positioned higher in the flue 118, the flue gases travel a shorter distance to reach the top end, and therefore retain more heat. With hotter flue gases at the top of the flue 118, the temperature difference between the flue gases and the water at that location is increased, so heat transfer efficiency is also increased, and the water at the top of the tank 104 can be more quickly heated to a higher temperature.

Finally, if the flame holder 130 is positioned higher in the flue 118, it may become difficult or impossible to heat water that is near the bottom of the tank 104, absent some means of circulating water in the tank 104. Thus, the effective capacity of the tank 104 may be reduced.

Factors that are affected by the selection of the position of the flame holder 130 within the flue 118, including the factors discussed above, weigh differently according to the particular intended use of the water heater system 100, and related considerations, such as anticipated consumption, duty cycle, and fuel costs. Thus, the selection of the position of the flame holder 130 is a design choice that may vary from system to system.

According to an embodiment, the flame holder 130 is positioned near the first end 117 of the flue 118. In other words, in the orientation shown in FIG. 1, the flame holder 130 is near the bottom of the flue 118, which enables a significant portion of the heat carried by the flue gases to be transferred to the flue 118 and the water before the flue gases exit the flue 118. According to another embodiment, the flame holder 130 is positioned at or below a midpoint of the flue 118. According to a further embodiment, the flame holder 130 is positioned at or below a position about one-third of the length of the flue 118 from the second end 119 of the flue.

According to another embodiment, the flame holder 130 is positioned between the midpoint of the flue 118 and the second end 119, in cases, for example, where the radiant energy contribution is desired to be maximized.

FIG. 2 is an enlarged perspective view 200 of the perforated flame holder 130 of FIG. 1, partially cut away to show additional details, according to an embodiment in which an electrical heating element 202 is positioned in contact with the flame holder 130. The flame holder 130 includes a first face 204, a second face 206, and a plurality of apertures 208 extending between the first and second faces 204, 206. In the embodiment shown, the electrical heating element 202 comprises a wire passing back and forth between the first and second faces 204, 206 through ones of the apertures 208. Ends 210 of the heating element 202 extend from the first face 204. According to an embodiment, the flame holder 130 of FIG. 2 is configured to be incorporated into a water heater system such as the system 100 of FIG. 1, in which case, the ends 210 of the heating element 202 are electrically coupled to the controller 120, which in turn is configured to control the application of a voltage across the heating element 202.

For example, according to an embodiment, during a start-up procedure, the controller 120 is configured to control application of a voltage across the heating element 202, causing it to become hot, and impart that heat to the portions of the flame holder 130 where the heating element 202 and the flame holder 130 are in contact. The controller 120 is then configured to admit fuel to the burner supply line 124 at normal operating pressure, which is ignited either by the heat of the heating element 202 or by heat imparted to the flame holder 130. Within a few seconds, the overall temperature of the flame holder 130 exceeds the minimum operating temperature, at which time the controller 120 is configured to stop the application of voltage.

Although, in the embodiment of FIG. 2, the heating element 202 is in the form of a wire element extending through ones of the apertures 208, according to other embodiments, the heating element 202 can be in any appropriate form, such as, for example, applied to one of the first or second faces 204, 206, integrated into the flame holder 130 during the manufacturing process, etc.

Figure 3:
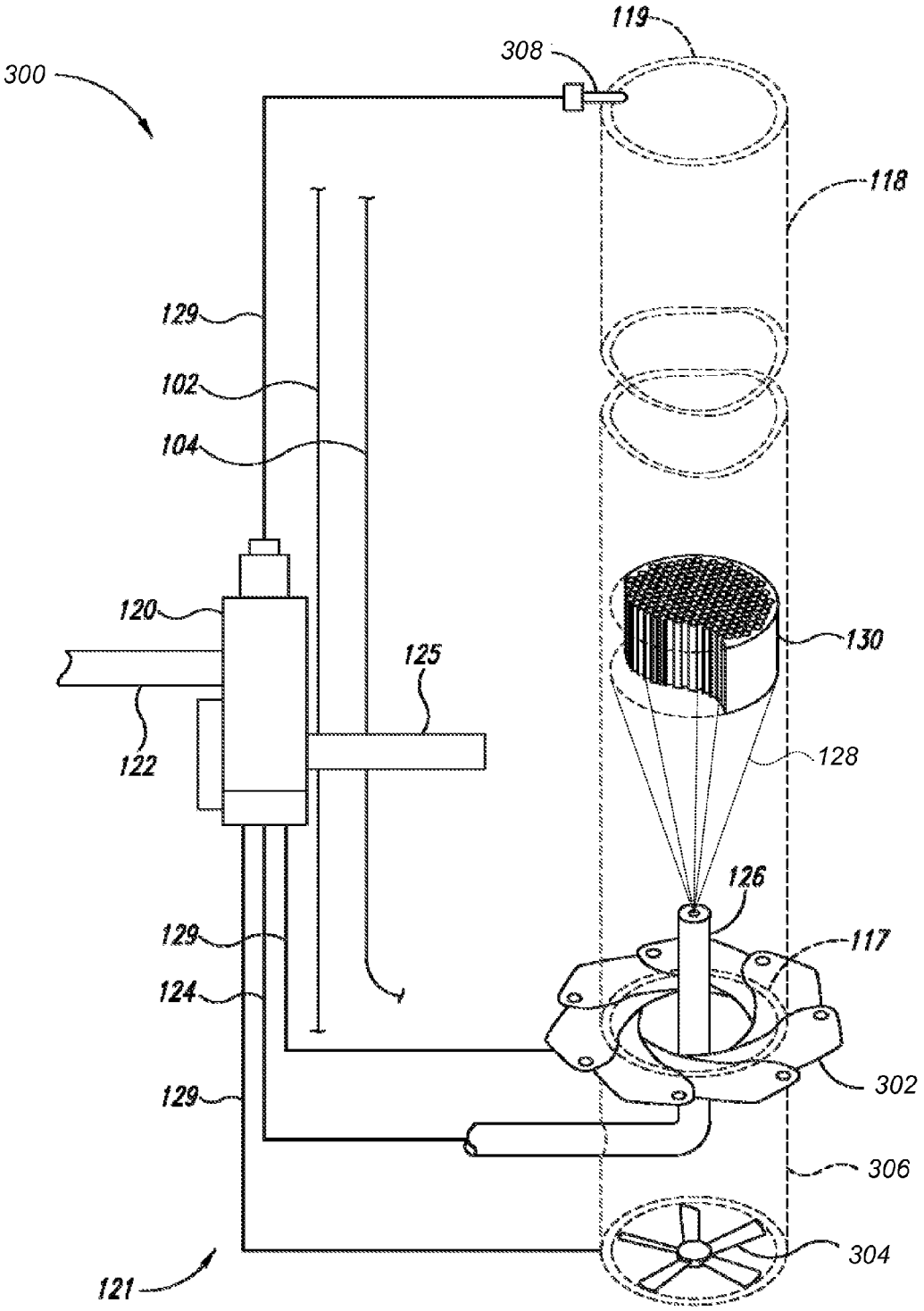
FIG. 3 is a diagram showing elements of a water heater system, according to an embodiment.

FIG. 3 is a detail of a water heater system 300, according to an embodiment. The diagram of FIG. 3 includes portions of the flue 118, depicted transparently to show various details of the burner mechanism 121. The burner mechanism 121 of the water heater system 300 includes the controller 120 and the temperature sensor 125. The mechanism 121 includes an additional sensor 308, coupled to the controller 120 via the connector 129, and positioned and configured to monitor one or more characteristics of the flame 132 (shown in FIG. 1) held by the flame holder 130. For example, the sensor 308 can be configured to monitor flue gas exiting the system, and to detect a level of oxygen ($O_2$), oxides of nitrogen (NOx), carbon monoxide (CO), carbon dioxide ($CO_2$), particulates, gas temperature, etc. Alternatively, or additionally, the sensor 308 can be positioned and configured to monitor flame characteristics, such as, e.g., flame position, luminosity, size, temperature, etc. According to an embodiment, the sensor 308 includes a plurality of individual sensors, each configured to monitor one or more characteristics of the operation of the system 300.

According to an embodiment, the sensor 308 includes one or more sensors configured to detect a current demand for hot water, such as, for example, a flow meter positioned in the inlet 108 or the outlet 109 (both shown in FIG. 1), configured to detect a volume of water flowing through the water heater, or additional water temperature sensors configured to detect the water temperature at various additional positions within the water tank 104.

The burner mechanism 121 of the system 300 also includes a shutter 302 and a compressor 304. Related embodiments include only the shutter 302, or only the compressor 304. In the embodiment shown, the shutter 302 is positioned at the first end 117 of the flue 118, and the compressor 304 is coupled to the flue 118 via a short conduit 306. The shutter 302 is configured to regulate a flow of air into the flue 118, and the compressor 304 is configured to modify air pressure and volume entering the first end 117 of the flue 118.

According to an embodiment, the controller 120 is configured to regulate operation of the burner system 121 in part on the basis of a signal or signals provided by the sensor 308. For example, the controller 120 can be configured to monitor the level of $O_2$ in the gases exiting the flue 118. An elevated $O_2$ level may indicate that the fuel/air mixture is excessively lean. In response, the controller 120 can be configured to control the shutter 302 to reduce the amount of air admitted into the first end 117 of the flue 118 to reduce the amount of $O_2$ in the mixture. Similarly, the controller 120 can be configured to control the compressor 304 to regulate the amount of air that enters the flue 118.

According to an embodiment, the shutter 302 is omitted, and the air supply is regulated entirely by operation of the compressor 304. The controller 120 is configured to control a speed and direction of rotation of the blades of the compressor 304. By increasing forward rotation of the compressor blades, air pressure is increased, and air flow into the flue 118 is also increased. In a case where it is desirable to reduce the air pressure or flow of air into the flue 118, the controller 120 is configured to reverse the rotation of the compressor blades, causing the incoming air pressure to drop even below the ambient pressure. Typically, reverse rotation of the compressor 304 will be relatively slow, to avoid reversing the flow of air and entirely starving the flame 132.

In an embodiment that includes both the shutter 302 and the compressor 304, the controller 120 can be configured to coordinate operation of the shutter 302 and the compressor 304 to control not only the volume of air that is admitted, but also the velocity at which the air enters the flue 118. For example, by partially closing the shutter 302 while at the same time increasing rotation of the compressor 304, the shutter 302 functions as a nozzle to admit a high-velocity stream of air into the flue 118 while simultaneously controlling the volume of air that enters.

According to an alternate embodiment, a fan is positioned at the second end 119 of the flue 118, configured to accelerate the flow of flue gases from the flue 118 and thereby reduce pressure in the top portion of the flue 118. With lower pressure at the top, air is drawn into the first end 117 of the flue 118 at an increased rate, thereby modifying the fuel/air mixture, etc.

As previously noted, air is entrained by the fuel stream 128 as it is emitted from the nozzle 126 and flows toward the flame holder 130. Various factors, including the distance between the nozzle 126 and the flame holder 130, the pressure at which the fuel stream 128 is emitted, the volume of fuel emitted, etc., are selected or controlled such that the fuel stream 128 will have a selected fuel/air ratio by the time it reaches the flame holder 130. However, in a system that includes one or both of a shutter 302 and a compressor 304, as described with respect to the water heater system 300 of FIG. 3, the fuel/air mixture of the fuel stream 128 can be adjusted without the need to modify any of the factors commonly controlled for that purpose, or can be adjusted to compensate for a configuration that would not otherwise function as intended.

For example, if for some reason it becomes necessary or desirable to reduce air entrainment so as to render the fuel/air mixture richer, the controller 120 can be configured to reduce the opening of the shutter 302 and/or reduce the speed of the compressor 304, thereby reducing the volume of air entering the flue 118. With less air entering the flue 118, less air is entrained by the fuel stream 128, and the mixture becomes richer. Conversely, the mixture can be made leaner by increasing the volume of air entering the flue 118, such as by incrementally opening the shutter 302 and/or by increasing the rotation speed of the compressor 304. Thus, a system designer has broader design options with regard to the relative spacing and positioning of the system elements, as well as with regard to the fuel volume and pressure. Additionally, adjustments can be made to accommodate a variety of fuel formulations, which may vary with regard to flame propagation speed, heat output for a given fuel volume, appropriate fuel/air ratio for efficient combustion, etc.

As previously explained, when starting up from a cold condition, the flame holder 130 should typically be preheated prior to operation in the heating mode. During a start-up procedure, according to some embodiments, some quantity of fuel is expended in the process of preheating the flame holder 130. Typically, a flame that is supported in the fuel stream 128 to preheat the flame holder 130 does not burn as efficiently as when the flame 132 is held by the perforated flame holder 130, nor is it as free of pollutants such as CO and NOx. Generally, a start-up burn lasts only a few seconds before the flame holder 130 reaches its minimum operating temperature, so the effects of the less desirable aspects of the burn are a minute part of the total operation of the water heater system. However, the inventors have recognized that if the system has a relatively fast duty cycle, so that it restarts frequently, the loss of efficiency and the production of pollutants can measurably affect the overall efficiency and cleanliness of the system. A fast duty cycle can be caused by various factors, including, for example, an increased demand for hot water, such that shortly after switching to standby mode, the supply is depleted, and a restart becomes necessary. Another example is a case in which a hysteresis range is too narrow, i.e., the temperature threshold at which start-up is initiated and the threshold at which the system switches from heating mode to standby are too close to each other.

In embodiments in which a relatively fast duty cycle is anticipated, use of an electrical heating element 202 to preheat the flame holder 130, as described with reference to FIG. 2, may reduce or eliminate undesirable aspects of the start-up cycle.

According to another embodiment, the controller 120 is configured to operate the system in a turndown mode in which the flow of fuel is reduced to a minimum level of efficient operation. Following a period of operation in the heating mode, once the water temperature has risen above the second threshold, the controller 120 is configured to reduce the fuel flow to the nozzle 126. At the same time, the volume of air admitted into the first end 117 of the flue 118 is reduced and/or the air velocity is increased, in order to control the fuel/air mixture and prevent the flame 132 from moving upstream toward the nozzle 126. Thus, the flame 132 continues to be held by the flame holder 130, but burns at a reduced rate. A larger percentage of the heat generated is retained to maintain the temperature of the flame holder 130, and a smaller amount of heat is transmitted to the water in the tank 104. In this way, the flame holder 130 is held above its minimum operating temperature in anticipation that the water heater system 300 will be able to transition quickly back to heating mode without first requiring a start-up procedure. If, during operation in the turndown mode, the water temperature rises to a third temperature threshold, higher than the second temperature threshold, the controller 120 is configured to transition to standby mode, in order to prevent overheating of the water.

According to an embodiment, the controller 120 is configured to detect an increase in the duty cycle and in response, to switch operation back and forth from turndown mode to heating mode. According to another embodiment, an operator control is provided, so that, for example, when increased hot water demand is anticipated, the system 300 can be commanded or programmed to operate in turndown/heating modes.

According to another embodiment, operation of the water heater system 300 in the heating mode includes operating the system within a range of heat-output levels. For example, during operation in the turndown mode, the burner mechanism 121 is at a selected minimum level of efficient operation. Below this level, fuel efficiency may be unacceptably low, or there may not be sufficient fuel to maintain the operating temperature of the flame holder 130, and the system risks an unintended shutdown. Thus, according to an embodiment, this level of operation defines the low end of a range of operation in a variable output heating mode. As fuel flow increases, at some level, the volume of fuel would exceed the capacity of the burner mechanism 121, and again drop below an acceptable fuel efficiency value, or begin to produce elevated levels of pollutants and/or unburnt fuel. According to an embodiment, this level of fuel flow, or a level slightly below this level, is a selected maximum level of efficient operation, and defines the high end of the range of operation in the variable output heating mode. A target water temperature is selected, such as, for example, a temperature that is about midway between a maximum acceptable water temperature and a minimum acceptable water temperature.

During operation of the water heater 300 in the variable output heating mode, the controller 120 controls the heat output of the flame holder 130 by regulating the fuel flow to the nozzle 126. As water temperature rises above the selected target water temperature, the controller 120 controls the fuel flow to reduce the heat output of the burner mechanism 121 toward the minimum level for efficient operation, while, as water temperature drops below the selected target water temperature, the controller 120 controls the fuel flow to increase the heat output of the burner mechanism 121 toward the maximum level for efficient operation. Thus, according to this embodiment, the heat output of the burner mechanism 121 is inversely related to the temperature of the water.

According to an embodiment, the controller 120 is configured to control the fuel flow rate using a negative feedback system, in which, in response to incremental increases in the water temperature, as indicated by a signal from the temperature sensor 125, the controller 120 is configured to incrementally decrease the fuel flow rate to the nozzle 126, and vice-versa.

According to another embodiment, the controller 120 is configured to determine the appropriate fuel flow rate by reference to a lookup table. The temperature range between the maximum and minimum acceptable water temperatures is divided into a plurality of segments, each of which is associated with a corresponding fuel flow rate. The controller 120 is configured to receive a signal from the temperature sensor 125 according to the instantaneous water temperature, and obtain the corresponding fuel flow rate from the lookup table.

While the water temperature remains between the maximum and minimum acceptable water temperatures, the water heater system 300 operates continually in the variable output heating mode. If the water temperature approaches to within a selected margin of the maximum acceptable water temperature, the controller 120 operates the burner mechanism 121 at the minimum level for efficient operation, i.e., the level corresponding to the turndown mode of operation, and if the water temperature reaches or exceeds the maximum acceptable water temperature, the controller 120 moves the system to the standby mode. On the other hand, if the water temperature drops to or below the minimum acceptable water temperature, the controller 120 controls the burner mechanism 121 to operate at the maximum level for efficient operation.

In this way, in a system with frequent or continuous demands for hot water, the water heater system 300 operates substantially continually at a level that approximately corresponds to an average demand for hot water.

According to another embodiment, a determination of the level of operation of the water heater system 300 is based, in part, on the current demand for hot water, or on the rate at which the water temperature changes. Thus, for example, if the demand increases, causing an accelerated drop in water temperature, the controller 120 is configured to increase the heat output of the burner mechanism 121 to a level that is greater than if the temperature drops to the same level at a slower rate. Conversely, if the demand reduces, so that the water temperature rises more quickly, the controller 120 is configured to reduce the heat output of the burner mechanism 121 to an output level that is lower than if the temperature rises to the same level at a slower rate. If the demand drops to near zero, the controller 120 is configured to reduce the heat output of the burner mechanism 121 to the minimum level for efficient operation at a water temperature that is significantly lower than the selected margin referred to above, so as to reduce the rate at which the temperature rises to a minimum, and thereby increase the time during which the burner mechanism 121 can remain in the turn-down mode. This embodiment of operation reduces the likelihood that the system 300 will be depleted by the increased demand, or that the water will reach the maximum acceptable temperature and be required to transition to standby mode.

In addition to the examples provided here, other known processes for control of a variable such as water may be adapted for use in controlling systems like those of the disclosed embodiments.

The controller 120 of the various disclosed embodiments is shown and described as a single element, but this is for convenience and ease of description. In practice, the functions of the controller 120 can be performed by a number of separate elements, such as, for example, where a stand-alone fuel valve is controlled by a separate processor, etc. Alternatively, some or all of the functions of the controller 120 can be performed by elements of the system that also perform other functions. For example, in a system that includes a compressor 304, the compressor can be configured to receive a signal directly from an $O_2$ sensor 308 as an input in a negative feedback loop, such that in response to an incremental increase of oxygen at the second end 119 of the flue 118, the compressor 304 incrementally reduces the air pressure at the first end 117.

Where a claim recites a controller configured to perform one or more specific functions, and where all of those functions are performed by any combination of elements of a system that otherwise meets the limitations of the claim, that claim reads on the system.

Figure 4:
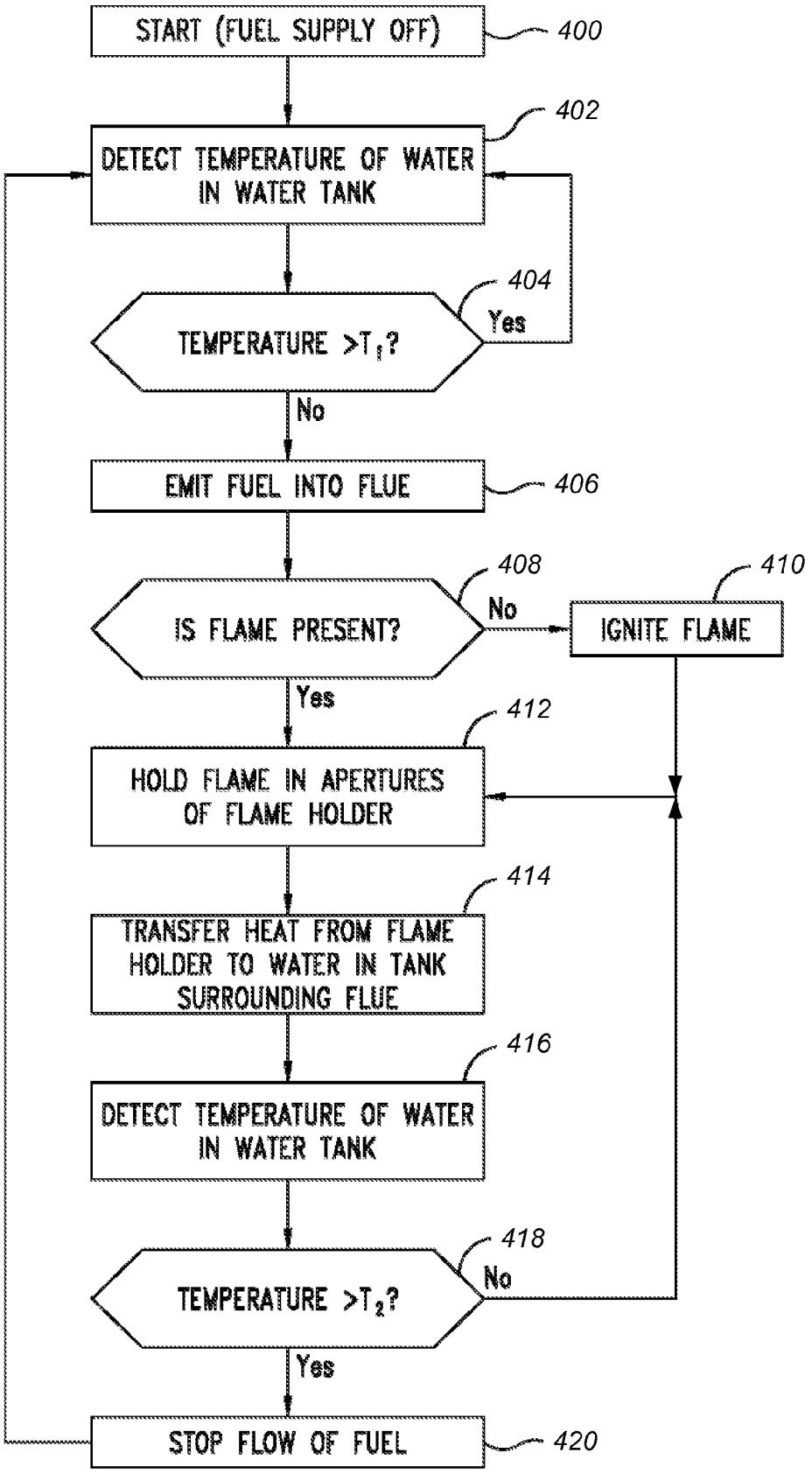
FIGS. 4-6 are flow diagrams illustrating methods of operation of a water heater system, according to respective embodiments.

FIG. 4 is a flow diagram illustrating a method of operation of a water heater system, according to an embodiment. The process begins at step 400, with the assumption that the system is off, i.e., in a standby mode, as described previously. At step 402, a temperature of water in a tank of the system is detected, and, at step 404, a determination is made whether the water temperature is greater than a first temperature threshold $T_1$. If the water is above the first temperature threshold $T_1$, the process returns to step 402 and begins again. If the temperature is below the first temperature threshold $T_1$, the process proceeds to step 406.

At step 406, fuel is emitted from a nozzle into a flue of the water heater system. At step 408, a flame is detected. If no flame is present, a flame is ignited in the fuel flow at step 410. The step of igniting the flame can also include preheating a perforated flame holder positioned within the flue, as described previously. At step 412, the flame is held in the apertures of a flame holder positioned inside the flue, and heat generated by the flame is transferred to water in the tank of the water heater system, at step 414.

The water temperature is again detected at step 416, and if, at step 418, the water is below a second temperature threshold $T_2$, which is higher than the first temperature threshold $T_1$, the process returns to step 412 and repeats from that point.

If, at step 418, the water is above the second temperature threshold $T_2$, the process proceeds to step 420, at which the fuel flow is shut off, so that combustion ends, and no more heat is generated for transfer to the water. The process then returns to step 402 and begins again.

According to an embodiment, during performance of step 420, a flag is set, indicating that fuel flow has been stopped. When the process cycles back around to step 408, in which a flame is detected, the status of the flag is checked, and, if found in the set condition, the flag is reset.

During normal operation of the system, a flame should always be present at step 408 except during the first performance of step 408 following the performance of step 420. Thus, if, during the performance of step 408, no flame is detected and the flag is not set, this indicates that an error has occurred, inasmuch as a flame should be present.

According to one embodiment, if no flame is detected at step 348, but the flag is not set, the process moves directly to step 420, at which the fuel flow is stopped, after which the system goes into an automatic standby or shut-down condition.

According to an alternate embodiment, if no flame is detected at step 408, but the flag is not set, a counter is incremented and the process continues as usual. When the cycle returns to step 408, if a flame is detected, the counter is reset to zero. If not, the counter is again incremented. When the counter reaches a preset value, indicating that a selected number of unsuccessful attempts have been made to ignite a viable flame, the process then moves to step 420, followed by a standby or shut-down, as previously described.

Figure 5:
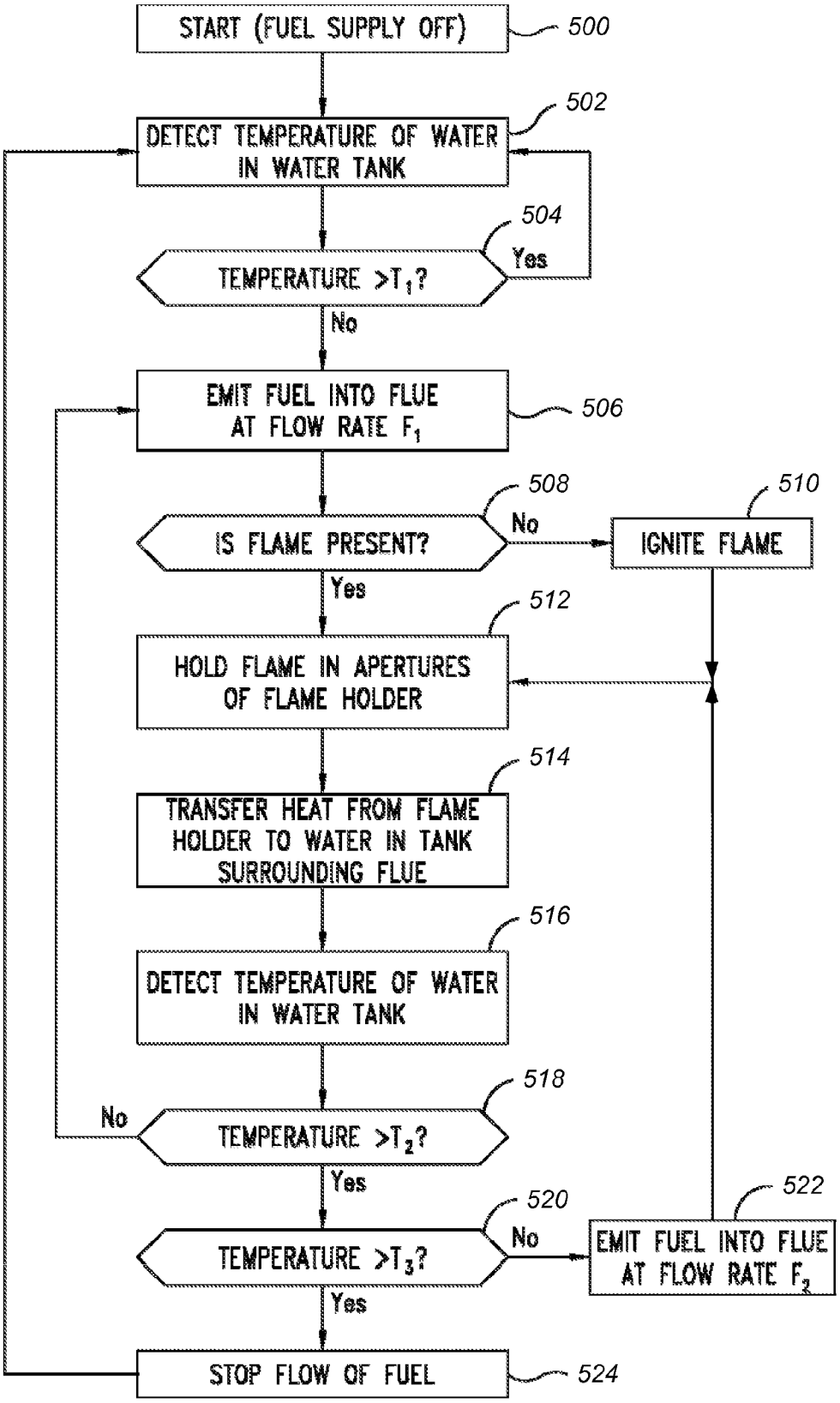

FIG. 5 is a flow diagram illustrating a method of operation of a water heater system, according to another embodiment. The process begins at step 500, with the assumption that the system is off. At step 502, a temperature of water in a tank of the system is detected, and, at step 504, a determination is made whether the water temperature is greater than a first temperature threshold $T_1$. If the water is above the first temperature threshold $T_1$, the process returns to step 502 and begins again. If the temperature is below the first temperature threshold $T_1$, the process proceeds to step 506.

At step 506, fuel is emitted from a nozzle into a flue of the water heater system at a first flow rate $F_1$. At step 508, a flame is detected. If a flame is present, the process proceeds to step 512, and if no flame is present, a flame is ignited in the fuel flow at step 510, prior to proceeding. At step 512, the flame is held in the apertures of a flame holder positioned inside the flue, and heat generated by the flame is transferred to water in the tank of the water heater system, at step 514.

The water temperature is again detected at step 516, and is compared with a second, higher temperature threshold $T_2$, at step 518. If the water temperature is below the second temperature threshold $T_2$, the process returns to step 506 and repeats from there. If the water temperature is above the second temperature threshold $T_2$, the process moves on to step 520, where a determination is made whether the water temperature is greater than a third temperature threshold $T_3$, which is greater than the second temperature threshold $T_2$. If the water is below the third temperature threshold $T_3$ (but above the second temperature threshold $T_2$), the process proceeds to step 522, at which the fuel flow is reduced to a flow rate $F_2$, then returns to step 512 and repeats from there, except that now, at the reduced flow rate $F_2$, the water heats more slowly. If, during operation of the system at the reduced flow rate $F_2$, the water temperature drops below the second temperature threshold $T_2$, then the next time the process cycles to step 516, the drop in temperature will be detected and in step 518 the temperature will be determined to be below $T_2$, and the process will again return to step 506, where the fuel will again be emitted at the first flow rate $F_1$, which will result in an increased heat output to compensate for the reduced temperature.

If, at step 520, the water is above the third temperature threshold $T_3$, the process then moves to step 524, at which the fuel flow is shut off, so that combustion ends, and no more heat is generated for transfer to the water. The process then returns to step 502 and begins again.

The process described with reference to FIG. 5 is a variation of the method of operation described above with reference to FIG. 4. The difference is that in the process of FIG. 5, the system is configured to operate at either of two heat output levels, depending upon the water temperature, so that, while the water temperature is at a relatively low level, the heat output is high, and while the water temperature is at a higher level, the heat output is reduced. This enables the system to operate more efficiently, because it has a longer duty cycle and fewer starts from standby mode.

According to an embodiment, the reduced flow rate $F_2$ of the process described with reference to FIG. 5 corresponds to a turndown flow rate, for operation of the water heater system in a turndown mode as previously described.

According to another embodiment, the first and second temperature thresholds $T_1$ and $T_2$ are identical, so that when the water temperature drops below the first temperature threshold $T_1$, the system operates at the higher flow rate $F_1$ only long enough to bring the temperature back to the first threshold temperature, then reduces the fuel flow to the lower flow rate $F_2$ while the water temperature is between the first and third temperature thresholds $T_1$ and $T_3$.

According to another embodiment, the first temperature threshold $T_1$ is greater than the second temperature threshold $T_2$. In this embodiment, the system operates to maintain a water temperature near the second temperature threshold $T_2$.

According to an embodiment, the process described with reference to FIG. 5 includes a safety procedure similar to that described above with reference the process of FIG. 4, in which the loss of a flame is detected during performance of step 508.

Figure 6:
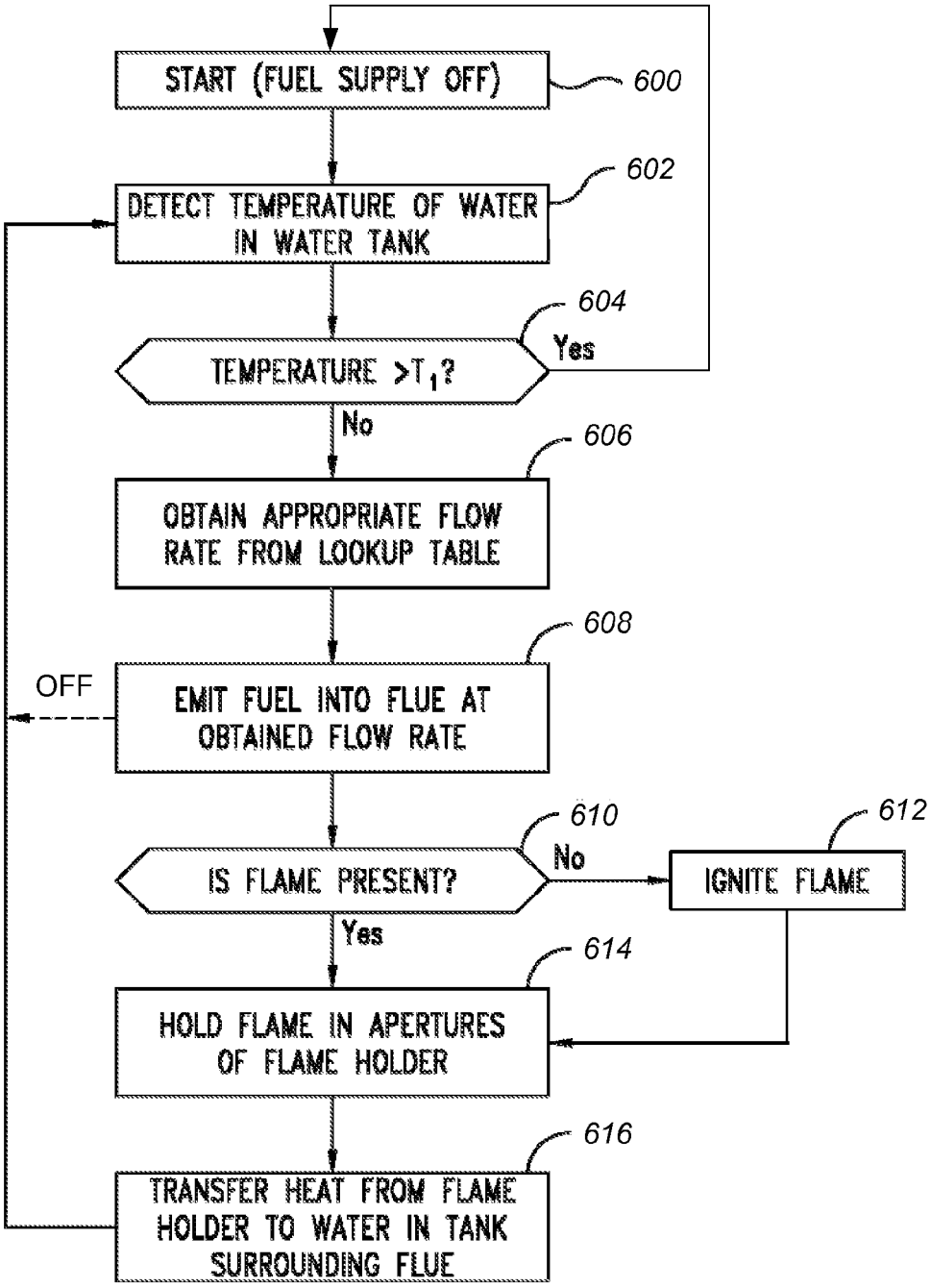

FIG. 6 is a flow diagram illustrating a method of operation of a water heater system, according to a further embodiment. The process begins at step 600, with the assumption that the system is off. At step 602, a temperature of water in a tank of the system is detected, and, at step 604, a determination is made whether the water temperature is greater than a temperature threshold $T_1$. If the water is above the temperature threshold $T_1$, the process returns to step 600 and begins again, with the fuel shut off. If the temperature is below the temperature threshold $T_1$, the process proceeds to step 606.

At step 606, a fuel flow rate is obtained that corresponds to the temperature detected in step 602. In the embodiment outlined in FIG. 6, the flow rate is obtained by reference to a lookup table. However, according to other embodiments, the flow rate is obtained in other ways, some of which are described above with reference to the embodiment of FIG. 3.

At step 608, fuel is emitted from a nozzle into a flue of the water heater system at the flow rate obtained in step 606 and proceeds to step 610, except where the lookup table indicates a fuel flow rate of zero. In that case, the prescribed flow rate is applied, but the process returns to step 602, via the OFF path shown.

At step 610, a flame is detected. If a flame is present, the process proceeds to step 614, and if no flame is present, a flame is ignited in the fuel flow at step 612 prior to proceeding. At step 614, the flame is held in the apertures of a flame holder positioned inside the flue, and heat generated by the flame is transferred to water in the tank of the water heater system, at step 616. The process then returns to step 602 and repeats from there.

According to an embodiment, the process described with reference to FIG. 6 includes a safety procedure similar to that described above with reference the process of FIG. 4, to prevent the continuous discharge of fuel into the flue when no flame is present.

The embodiment described with reference to FIG. 6 is for use with systems capable of operating in a variable-output mode of operation, as previously described. It should be noted that in the embodiment outlined in FIG. 6, the YES path of step 604 returns to a condition in which the fuel flow is shut off, separate from the step 608 of applying a flow rate obtained from the lookup table. While it may be presumed that the lookup table will also include a direction to stop the fuel flow if the temperature reaches a maximum acceptable temperature, the shut-down procedure implied by the return to step 600 is performed independently of the steps 606 and 608 that include obtaining and applying values from the lookup table. This redundancy provides a fail safe to reduce the likelihood of a malfunction that results in a dangerously high water temperature.

According to an embodiment, the water heater system includes a separate valve in the fuel supply line, configured to close if the water temperature rises above a safety threshold. The system is configured to operate in a narrower temperature range, so that during normal operation, the water temperature never reaches the temperature threshold of step 604. Instead, the system is configured to control and even stop the fuel flow on the basis of instructions obtained from the lookup table. However, in the event of a malfunction in which the maximum acceptable temperature of the system is exceeded, the elevated temperature is detected and the fuel cut off before a dangerous condition results.

Various methods of operation are described above, in which a water heater system is controlled according to a temperature of the water in a tank. According to an embodiment, the controller is configured to determine an aggregate temperature, and to control the system accordingly. For example, the controller may be configured to receive signals from a plurality of temperature sensors corresponding to water temperature at respective locations within the tank, and to derive an aggregate value based on the plurality of signals.

As hot water is drawn from the tank and cold water introduced, the water temperature at various locations within the tank will vary. Furthermore, temperature gradients within the tank may also vary, depending on the rate at which cold water is introduced. For example, water entering the tank at a high flow rate—which would occur during periods of high demand—may be more energetic and produce more turbulence, so that mixing will occur at a higher position in the tank. In systems that employ a single temperature sensor, with increased mixing the temperature drop at the sensor location may be more gradual, and may actually delay a response to a drop in temperature when demand for hot water is high. However, in a system employing multiple sensors, water temperature at various locations can be tracked, and changes or variations compensated for.

According to one embodiment, the controller is configured to derive an average temperature value, and to control operation of the system on that basis.

According to another embodiment, the signals are weighted according to the positions of the corresponding sensors. According to a further embodiment, the weighting varies according to a detected temperature. Thus, for example, a signal from a sensor located near the bottom of the tank may be accorded small overall influence at lower temperatures, inasmuch as incoming cold water drops directly to the bottom, so that sensor will be the first to show a drop in temperature. However, at higher temperatures, the same signal may be given much more weight, inasmuch as the water at the bottom of the tank will also be the last to heat. A temperature that, if detected near the top of the tank would be considered normal, might, when detected at the bottom, be an indication of dangerous overheating.

According to another embodiment, the controller is configured to receive a signal corresponding to a rate of flow of water at the inlet or outlet of the tank. When a high demand for hot water occurs, the controller is configured to respond more quickly to a temperature drop and begin heating sooner, thereby increasing the effective output capacity of the system. Detection of a high demand can be based on the rate of flow of water into or out of the system, or on volume, i.e., a combination of flow rate and time.

According to an embodiment, when a high demand is detected, the controller is configured to adjust "turn-on" temperature thresholds upward, and/or adjust "turn-off" thresholds downward. When a high demand for hot water occurs, a rise in turn-on thresholds results in the system cycling to a heating mode of operation at a higher temperature so that less hot water is drawn before the system begins heating. A rise in turn-off thresholds results in the system continuing in a heating mode beyond the point at which it would otherwise transition to a lower mode of operation or to a standby mode.

Figure 7:
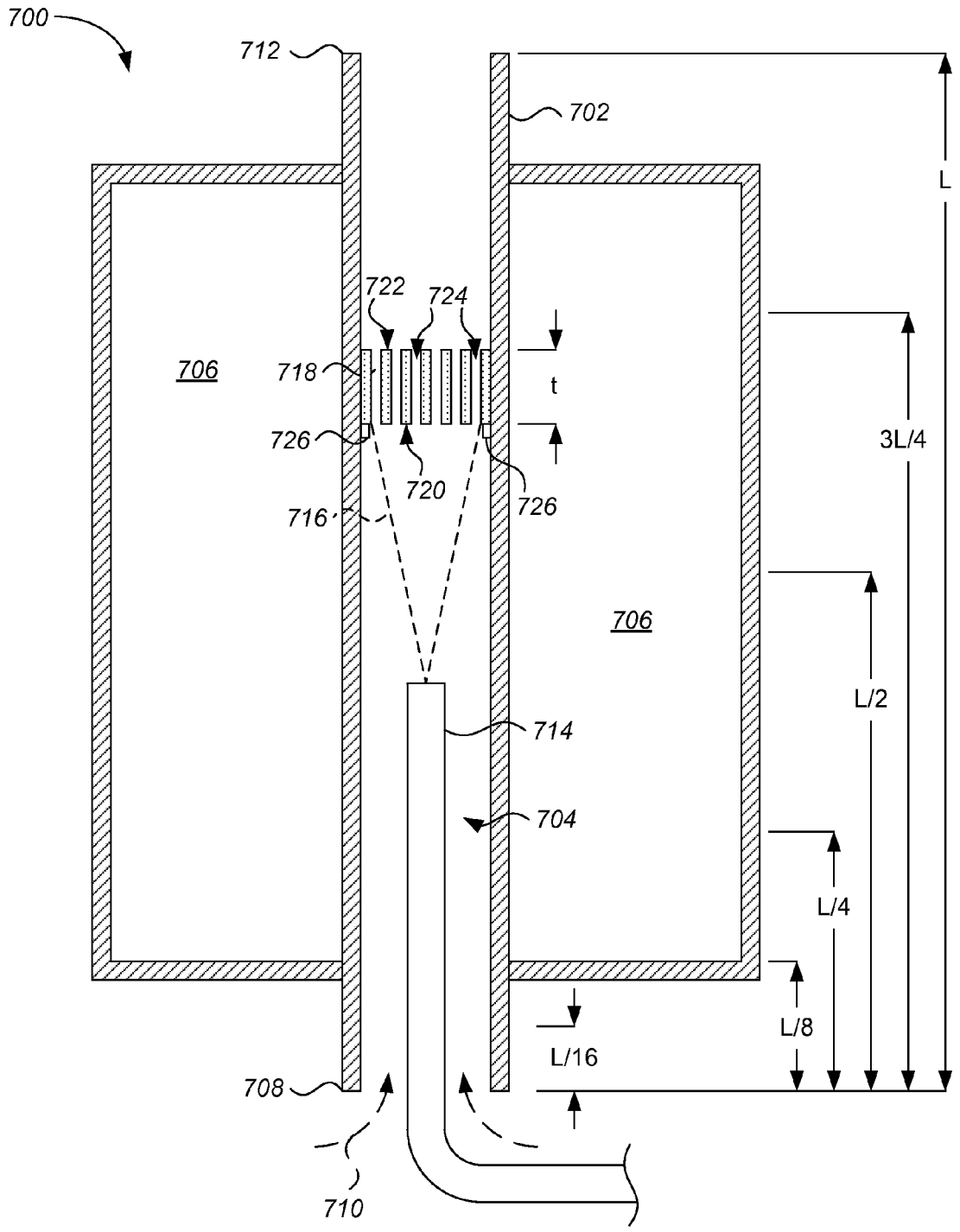
FIG. 7 is a side sectional diagram of a water heater with a perforated flame holder, according to an embodiment.

FIG. 7 is a side sectional diagram of a water heater 700 with a perforated flame holder 718, according to an embodiment. The water heater 700 includes a combustion tube 702 having a length L, the combustion tube 702 defining an air column 704 on an inside of the tube and a water volume 706 outside of the tube. The combustion tube 702 has an inlet end 708 configured to receive combustion air 710 and an outlet end 712 configured to output combustion products.

As used herein, the length along the combustion tube 702 will use the convention that the inlet end 708 is a position zero (0) and the outlet end 712 is at position L. Generally, in domestic water heating applications using a conventional tank, the combustion tube 702 can be vertically aligned, about 5 inches in diameter, the length about 2 to 6 feet, and be made of steel. In other domestic water heating applications of the "on demand" variety, the size, orientation, and material of the combustion tube 702 can be different. Other applications to which the present disclosure applies include a variety of commercial and industrial heaters in which low NOx output is desired, especially applications that can be classified as "cool wall" burners.

A fuel nozzle 714 is configured to output a fuel stream 716 into the air column 704 inside of the combustion tube 702. For example, the fuel nozzle can be a hydrocarbon gas nozzle 714 configured to output a hydrocarbon gas stream 716 into the air column 704 inside of the tube 702. For ease of description, the fuel will be described as hydrocarbon gas hereafter.

A perforated flame holder 718 is disposed in the air column 704. The perforated flame holder 718 can have a body with a thickness t, the body defining an input side 720 aligned to receive the hydrocarbon gas stream 716 and the combustion air 710, an output side 722 opposite the input side 720 disposed to output the combustion products, and a plurality of perforations 724 extending through the thickness t from the input side 720 to the output side 722. The perforated flame holder 718 is configured to hold a combustion reaction supported by the hydrocarbon gas and the combustion air 710 within the plurality of perforations 724. A support structure 726 is configured to support the perforated flame holder 718 between the inlet end 708 and the outlet end 712 of the combustion tube 702. For example, the support structure 726 can support the perforated flame holder 718 at a distance not equal to L/4 from the inlet end 708 of the combustion tube 702.

In an embodiment, the support structure 726 is configured to support the perforated flame holder 718 such that the entire thickness t of the perforated flame holder 718 is between the inlet end 708 and the distance L/4 from the inlet end 708 of the combustion tube 702. The inventors found that in this embodiment, the farther the perforated flame holder 718 was below L/4, the more reliably combustion was maintained. In an example, the support structure 726 can be configured to support the perforated flame holder 718 such that a section of the combustion tube 702 at a distance of L/8 or less from the inlet end 708 of the combustion tube 702 passes through the perforated flame holder body between the input side 720 and the output side 722. In another example, the support structure 726 can be configured to support the perforated flame holder 718 such that a section of the combustion tube 702 at a distance of L/16 or less from the inlet end 708 of the combustion tube 702 passes through the perforated flame holder body between the input side 720 and the output side 722. In these and other examples, the term "section" refers to a cross-section of the combustion tube 702.

In another embodiment, the support structure 726 can be configured to support the perforated flame holder 718 such that the entire thickness t of the perforated flame holder 718 is between the outlet end 712 of the combustion tube 702 and the distance L/4 from the inlet end 708 of the combustion tube 702. For example, the support structure 726 can be configured to support the perforated flame holder 718 such that a section of the combustion tube 702 at a distance of L/2 or more from the inlet end 708 of the combustion tube 702 passes through the perforated flame holder body between the input side 720 and the output side 722. In another example, the support structure 726 can be configured to support the perforated flame holder 718 such that a section of the combustion tube 702 at a distance of 3 L/4 or more from the inlet end 708 of the combustion tube 702 passes through the perforated flame holder body between the input side 720 and the output side 722.

During experiments, especially with the perforated flame holder 718 disposed near the position L/4, the support of combustion by the perforated flame holder 718 was found to correspond to an output of audible noise from the combustion tube 702. The support structure 726 can be configured to support the perforated flame holder 718 between the inlet end 708 and the outlet end 712 of the combustion tube 702 at a distance selected to not produce audible noise, or to produce only minimal audible noise. The inventors believe the audible noise is different than, but is perhaps related to the phenomenon of Rijke resonance, wherein a heated metal gauze, when placed in an open ended tube near the bottom of the tube at a distance corresponding to an antinode of a resonance harmonic of the tube will cause audible resonance. Embodiments of the present description are different because, to the inventors' knowledge, Rijke resonance has never been described for a system including a perforated flame holder that carries a combustion reaction supported inside a combustion tube.

Figure 8:
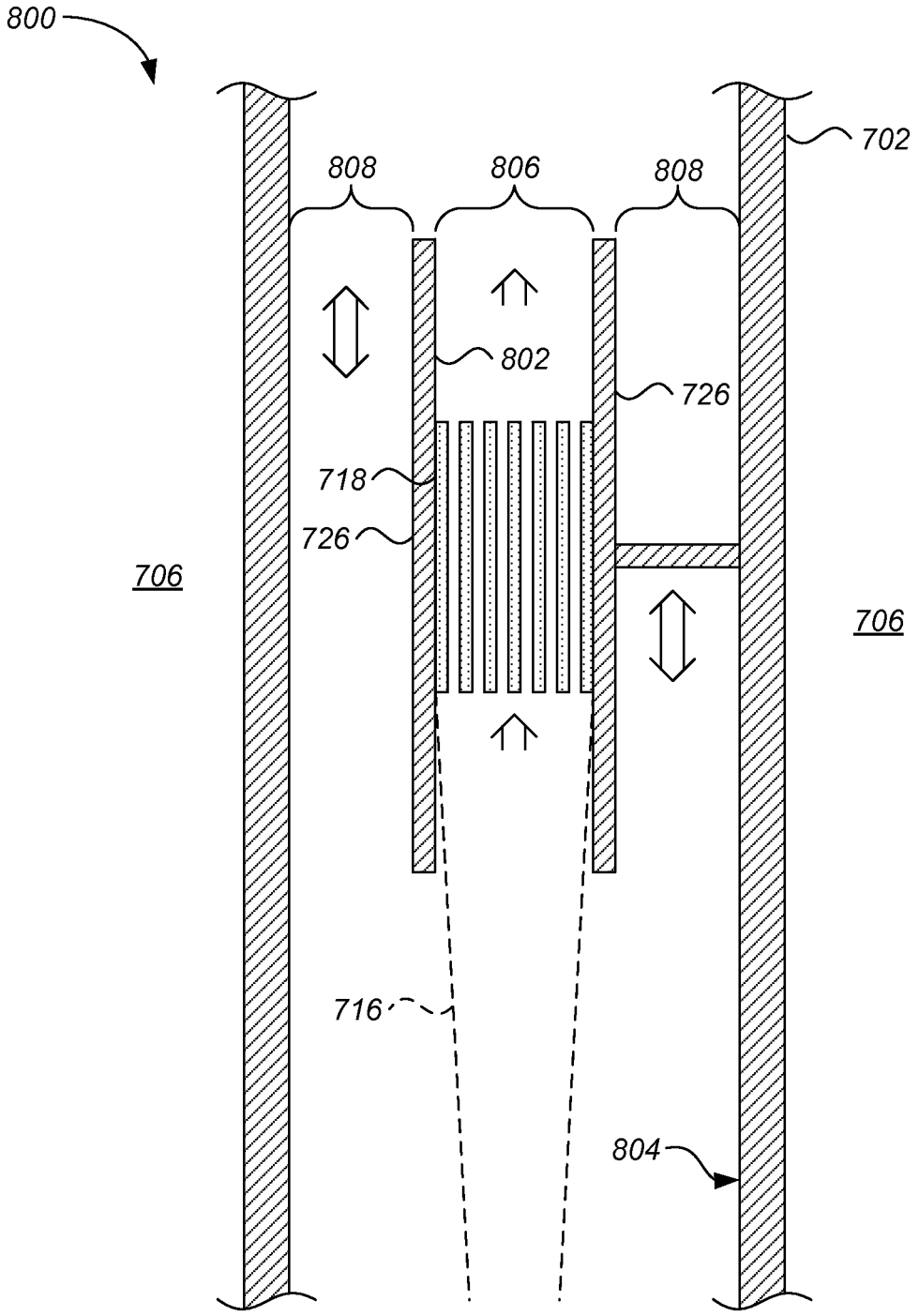
FIG. 8 is a side sectional diagram of a portion of a water heater with a perforated flame holder and a support structure, according to an embodiment.

FIG. 8 is a side sectional diagram of a portion of a water heater 800 with a perforated flame holder 718 and a support structure 726, according to an embodiment. The inventors found that it could be difficult to maintain reliable combustion in a perforated flame holder in cool wall applications. Accordingly, the inventors contemplate the arrangement of FIG. 8.

The support structure 726 can include a support tube 802 configured to support the perforated flame holder 718 a distance away from an inside wall 804 of the combustion tube 702. The inventors refer to the support tube 802 as a reradiator.

The support tube 802 can be configured to receive at least a portion of infrared radiation from the perforated flame holder 718 and reflect or absorb and reradiate infrared energy to the inside wall 804 of the combustion tube 702. This approach can reduce the temperature difference between the perforated flame holder 718 and the surface it is outputting infrared radiation to. In turn, this can reduce the amount of radiation from the perforated flame holder 718 and help keep the perforated flame holder 718 at its desirable operating temperature. The inventors believe this approach can be useful for any cool wall application of perforated flame holders.

In an embodiment, the support tube 802 defines an area 806 selected for substantially unidirectional flow of the hydrocarbon fuel, combustion air, and combustion products, and an annular area 808 selected to support bidirectional flow of the air column 704 (shown in FIG. 7) inside the combustion tube 702. The bidirectional flow can be related to Rijke resonance. By reducing any tendency for backward flow through the apertures of the perforated flame holder, more stable combustion may be maintained.

In many of the processes described in the present disclosure, some parameter is detected, measured, or determined. As used in the specification and claims, terms such as measure, detect, determine, etc. are not limited to actually obtaining a quantitative value for comparison or calculation. For example, the process described with reference to FIG. 3 includes the steps of detecting the temperature of water in the tank, and determining whether the detected temperature exceeds a first temperature threshold. While some systems may be configured to provide an actual temperature value, there are many alternative solutions that are acceptable. For example, if the temperature sensor is a transducer configured to provide a voltage signal that varies directly with the temperature of the water, the water temperature can be accurately inferred from the value of the voltage signal, but obtaining a temperature value in degrees, may not be necessary. The temperature threshold can be represented by a reference voltage that corresponds to the threshold temperature, and the comparison of the water temperature with the temperature threshold can be performed using a comparator circuit coupled to receive the voltage signal from the transducer at a first input, and the reference voltage at a second input. The comparator circuit is configured to produce one of two binary values, depending on which of the two voltage signals is greater.

It can be seen that, in the arrangement described, the water temperature is not measured or determined, in a narrow sense of the term, nor is such a value compared with an actual threshold temperature. Instead, a voltage signal that is representative of the detected temperature is compared with a voltage signal that is representative of a threshold temperature, with the necessary determination being made on the basis of the comparison. Nevertheless, where such a configuration is adequate to make the necessary determination, it is considered to perform the corresponding steps, and would thus fall within the scope of a claim that includes a term such as detect, measure, or determine in a definition of such an operation or structure.

Ordinal numbers, e.g., first, second, third, etc., are used in the claims according to conventional claim practice, i.e., for the purpose of clearly distinguishing between claimed elements or features thereof. The use of such numbers does not suggest any other relationship, e.g., order of operation or relative position of such elements. Furthermore, ordinal numbers used in the claims have no specific correspondence to such numbers used in the specification to refer to elements of disclosed embodiments on which those claims read, nor to numbers used in unrelated claims to designate similar elements or features.

Where a method claim recites one or more steps whose performance is conditional upon the results of another step, and where the other step is repeated, any step or steps whose conditions are met by the results of the repeat are to be performed following the repeat, even if such step or steps were also performed prior to the repeat. Thus, for example, where a first claim limitation recites detecting a temperature, and a second limitation recites taking an action if the temperature exceeds a threshold then repeating the step of detecting a temperature, if the detected temperature exceeds the threshold in the first iteration, then the second step is performed, in which the action is taken and the detecting step is repeated, and if the detected temperature also exceeds the threshold during the next iteration, the second step is again repeated, etc.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A fluid heater, comprising:

a tank having an inlet and an outlet;

a flue extending through the tank and having first and second ends;

a nozzle positioned and configured to emit a fuel stream into the flue;

a flame holder having a plurality of apertures extending therethrough and configured to hold a flame substantially within the plurality of apertures, the flame holder being located inside the flue, positioned to receive the fuel stream and to hold the flame entirely within the flue; and a controller configured to control a flow of fuel to the nozzle according to a temperature of a fluid within the tank;

wherein the controller is configured to stop the flow of fuel while the temperature of the fluid exceeds a first temperature threshold;

wherein the controller is configured to admit the flow of fuel while the temperature of the fluid is no greater than the first temperature threshold; and wherein the controller is configured to transition from stopping the flow of fuel to admitting the flow of fuel when the temperature of the fluid drops from a temperature greater than the first temperature threshold to a temperature no greater than a second temperature threshold, lower than the first temperature threshold.

2. A fluid heater, comprising:

a tank having an inlet and an outlet;

a flue extending through the tank and having first and second ends;

a nozzle positioned and configured to emit a fuel stream into the flue;

a flame holder having a plurality of apertures extending therethrough and configured to hold a flame substantially within the plurality of apertures, the flame holder being located inside the flue, positioned to receive the fuel stream and to hold the flame entirely within the flue; and a controller configured to control a flow of fuel to the nozzle according to a temperature of a fluid within the tank;

wherein the controller is configured to transition from stopping the flow of fuel to admitting the flow of fuel when the temperature of the fluid drops below a first temperature threshold.

3. The fluid heater of claim 2, wherein the controller is configured to preheat the flame holder during a transition from stopping the flow of fuel to admitting the flow of fuel.

4. The fluid heater of claim 3, wherein the controller is configured to preheat the flame holder by holding a preheat flame between the nozzle and the flame holder.

5. The fluid heater of claim 3, wherein the controller is configured to preheat the flame holder by applying a voltage to an electrical heating element in contact with the flame holder.

6. A fluid heater, comprising:

a tank having an inlet and an outlet;

a flue extending through the tank and having first and second ends;

a nozzle positioned and configured to emit a fuel stream into the flue; and a flame holder having a plurality of apertures extending therethrough and configured to hold a flame substantially within the plurality of apertures, the flame holder being located inside the flue, positioned to receive the fuel stream and to hold the flame entirely within the flue;

wherein the fluid heater further comprises a water heater comprising:

a combustion tube having a length L, the combustion tube defining an air column on an inside of the tube and a water volume outside of the tube and inside the tank, the tube having an inlet end configured to receive combustion air and an outlet end configured to output combustion products;

wherein the nozzle comprises a hydrocarbon gas nozzle configured to output a hydrocarbon gas stream into the air column inside of the tube;

wherein the flame holder comprises a perforated flame holder disposed in the air column, the perforated flame holder having a body with a thickness t, the body defining an input side aligned to receive the hydrocarbon gas stream and the combustion air, an output side opposite the input side disposed to output the combustion products, and wherein the apertures comprise a plurality of perforations extending through the thickness t from the input side to the output side, the perforated flame holder being configured to hold a combustion reaction supported by the hydrocarbon gas and the combustion air within the plurality of perforations; and further comprising:

a support structure configured to support the perforated flame holder between the inlet end and the outlet end of the combustion tube at a distance not equal to L/4 from the inlet end of the combustion tube.

7. The fluid heater of claim 6, wherein the support structure is configured to support the perforated flame holder such that the entire thickness t of the perforated flame holder is between the inlet end and the distance L/4 from the inlet end of the combustion tube.

8. The fluid heater of claim 7, wherein the support structure is configured to support the perforated flame holder such that a section of the combustion tube at a distance of L/8 or less from the inlet end of the combustion tube passes through the perforated flame holder body between the input side and the output side.

9. The fluid heater of claim 8, wherein the support structure is configured to support the perforated flame holder such that a section of the combustion tube at a distance of L/16 or less from the inlet end of the combustion tube passes through the perforated flame holder body between the input side and the output side.

10. The fluid heater of claim 6, wherein the support structure is configured to support the perforated flame holder such that the entire thickness t of the perforated flame holder is between the outlet end of the combustion tube and the distance L/4 from the inlet end of the combustion tube.

11. The fluid heater of claim 10, wherein the support structure is configured to support the perforated flame holder such that a section of the combustion tube at a distance of L/2 or more from the inlet end of the combustion tube passes through the perforated flame holder body between the input side and the output side.

12. The fluid heater of claim 11, wherein the support structure is configured to support the perforated flame holder such that a section of the combustion tube at a distance of 3 L/4 or more from the inlet end of the combustion tube passes through the perforated flame holder body between the input side and the output side.

13. The fluid heater of claim 6, wherein the support structure is configured to support the perforated flame holder between the inlet end and the outlet end of the combustion tube at a distance selected to not produce audible noise.

14. The fluid heater of claim 6, wherein the support structure further comprises:

a support tube configured to support the perforated flame holder a distance away from an inside wall of the combustion tube.

15. The fluid heater of claim 14, wherein the support tube is configured to receive infrared radiation from the perforated flame holder and reflect infrared energy to the inside wall of the combustion tube.

16. The fluid heater of claim 14, wherein the support tube defines an area selected for substantially unidirectional flow of the hydrocarbon fuel, combustion air, and combustion products and an annular area selected to support bidirectional flow of the air column inside the combustion tube.

* * * * *